US005954329A

United States Patent [19]

Kobayashi et al.

[11] Patent Number: 5,954,329

[45] Date of Patent: Sep. 21, 1999

[54] DOCUMENT FEEDER HAVING AN IMPROVED SEPARATOR MECHANISM

[75] Inventors: Hiroshi Kobayashi; Toru Tanjo; Hiroyuki Harada; Kazuhisa Kondo; Jun Kusakabe; Masahiro Sako, all of Osaka, Japan

[73] Assignee: Mita Industrial Co., Ltd., Oskaka, Japan

[21] Appl. No.: 09/005,832

[22] Filed: Jan. 12, 1998

[30] Foreign Application Priority Data

Jan. 17, 1997 [JP] Japan ..... 9-007036
Jan. 17, 1997 [JP] Japan ..... 9-007037

[51] Int. Cl.[6] ..... B65H 3/52

[52] U.S. Cl. ..... 271/122; 271/273

[58] Field of Search ..... 271/122, 121, 271/273

[56] References Cited

U.S. PATENT DOCUMENTS 4,872,659 10/1989 Kato et al. ..... 271/273 X
5,344,134 9/1994 Saeki et al. ..... 271/122
5,878,318 3/1999 Sako et al. ..... 399/367

*Primary Examiner*—David H. Bollinger
*Attorney, Agent, or Firm*—Smith, Gambrell & Russell, LLP; Beveridge, DeGrandi, Weilacher & Young

[57] ABSTRACT

A document feeder which includes a separator mechanism having a first separator member and a second separator member for separating and feeding document originals one by one into a document transportation path. The first separator member is provided in a main body, and the second separator member is provided in a cover which covers a portion of the main body and is adapted to be pivotally opened. With the cover being closed, the second separator member is positioned with respect to the first separator member by a positioning mechanism.

11 Claims, 9 Drawing Sheets

DOCUMENT FEEDER HAVING AN IMPROVED SEPARATOR MECHANISM

BACKGROUND OF THE INVENTION

1. Field of the Invention

The present invention relates to an automatic document feeder to be applied to an image processing apparatus such as a copying machine, a facsimile machine or an image reader.

2. Description of Related Art

Automatic document feeders are conventionally known which are applied to copying machines and the like and adapted to separate document originals set on a document placing plate on a one-by-one basis and feed the separated document original to a copying position through a document transportation path. The separation of the document originals is typically achieved by cooperation of a separator roller and a separator belt.

The positional relation between the separator roller and the separator belt is important in order to assuredly prevent plural document feeding and separate the lowermost document original from the other document originals. Therefore, it is basically preferred that the separator roller and the separator belt are fixed in place to maintain a predetermined positional relation. However, paper jam in a sheet transportation system is unavoidable, and the fixing of the separator roller and the separator belt makes it difficult to perform a jam recovery operation.

In order to facilitate the jam recovery operation with a separator roller and a separator belt maintained in a predetermined positional relation, a conventional document feeder is constructed such that a cover openable with respect to a main body is attached to the main body and the separator belt is slightly brought apart from the separator roller when the cover is opened.

More specifically, the separator belt is attached to the main body with its one axial side fixed to the main body and with its other axial side being vertically movable pivotally about the one axial side and, when the cover is closed, a pressure is applied to the other axial side of the separator belt. Therefore, when the cover is opened, the pressure applied to the separator belt is relieved so that the other axial side of the separator belt can be brought apart from the separator roller. Since the one axial side of the separator belt is fixed, the positioning of the separator belt with respect to the separator roller can be controlled to a certain extent when the cover is closed.

With this construction, since the separator belt cannot fully be brought apart from the separator roller but only the one axial side thereof can be brought apart from the separator roller, the separator belt hinders the removal of a jammed document original. Therefore, the jam recovery operation cannot readily be performed.

In order to assuredly separate a document original, a separator belt should be positioned with respect to a separator roller in an overlapped relation with a predetermined overlap amount. The overlap amount corresponds to a distance between a top portion of the separator roller and an under face of the separator belt.

In the aforesaid conventional document feeder, the proper positioning of the separator belt with respect to the separator roller is not maintained when the cover is opened. Therefore, when the cover is closed after the jam recovery operation, the separator belt should accurately be positioned with respect to the separator roller. To this end, the conventional document feeder employs an overlap defining member for defining the overlap amount. The overlap defining member permits the separator belt to be positioned with respect to the separator roller with the predetermined overlap amount when the cover is closed.

However, users may use document originals having different thicknesses. Therefore, fixing the overlap amount may result in document feeding failures such as plural document feeding.

In the prior art, if the overlap amount is not suitable for a document thickness, an overlap defining member providing a proper overlap amount for this particular document thickness should be employed. This entails a troublesome operation for replacement of the overlap defining member.

SUMMARY OF THE INVENTION

It is a first object of the present invention to provide a document feeder which ensures an easier document jam recovery operation.

It is a second object of the present invention to provide a document feeder which features easier overlap amount adjustment.

In accordance with a first aspect of the present invention, there is provided a document feeder which comprises: a main body; a cover covering a portion of the top face of the main body and adapted to be pivotally opened; a separator mechanism having a first separator member provided in the main body and a second separator member provided in the cover in such a manner that the second separator member is opposed to the first separator member when the cover is closed, the first and second separator members cooperating to separate and feed document originals one by one into a document transportation path; and a positioning mechanism for positioning the second separator member with respect to the first separator member with the cover being closed.

The positioning of the second separator member with respect to the first separator member means that the second separator member is positioned with respect to the first separator member in an overlapped relation with a predetermined distance (overlap amount) between the first and second separator members.

In accordance with the invention, the jam recovery operation can readily be performed because the second separator member is brought apart from the first separator member when the cover is opened. In addition, the second separator member can properly be positioned with respect to the first separator member by the positioning mechanism with the cover being closed. Therefore, the document separating performance is not changed by the opening and closing of the cover.

In accordance with one embodiment of the present invention, the positioning mechanism includes a positioning member attached to the second separator member, and a receiving member provided in the main body for receiving the positioning member with the cover being closed.

With this arrangement, the positioning of the second separator member with respect to the first separator member can be achieved by receiving the positioning member attached to the second separator member on the receiving member provided in the main body. Therefore, even if the cover is positioned in an offset relation with respect to the main body, the second separator member can be properly positioned with respect to the first separator member with a high accuracy.

The second separator member may be attached to the cover with at least a portion thereof being movable with respect to the cover.

With this arrangement, the second separator member is partially movable with respect to the cover. Therefore, even if the cover deforms due to aging thereof, this arrangement will accommodate the deformation so as not to reduce the accuracy of the positioning of the second separator member with respect to the first separator member.

The second separator member may include an endless belt stretched around a pair of pulleys and a pair of coupling arms each defining a distance between corresponding ends of shafts of the pulleys and coupling the pulley shafts, and at least one of the pulley shafts may be movably attached to the cover. In this case, the positioning member may include a first positioning member provided on one of the pulley shaft and a second positioning member provided on the coupling arm, and the receiving member may include a first receiving portion for receiving the first positioning member at a vertical level defined thereby with the cover being closed and a second receiving portion for receiving the second positioning member at a vertical level defined thereby with the cover being closed.

With this arrangement, the first and second positioning members are provided at two different positions along the length of the coupling arm, and adapted to be received by the first and second receiving portions provided in the main body at the vertical levels defined thereby. More specifically, the positioning of the coupling arm is determined by defining the vertical levels at the two positions along the length thereof with the cover being closed. Therefore, the proper positioning of the second separator member with respect to the first separator member can be ensured by defining the vertical levels such that the second separator member can be positioned with respect to the first separator member with a predetermined distance therebetween.

The shafts of the pulleys may be provided in the cover with a play allowed in a document transportation direction, and either one of the first and second receiving portions may serve to position the correspond ing positioning member with respect to the document transportation direction.

Where the shafts of the pulleys are provided in the cover with a play allowed in the document transportation direction, it may be difficult to assuredly position the second separator member with respect to the first separator member simply by defining the vertical level of the coupling arm at the two positions along the length thereof.

With this arrangement, however, either one of the first and second positioning members is positioned with respect to the document transportation direction by the corresponding receiving portion, so that the second separator member can assuredly be positioned with respect to the first separator member.

In accordance with a second aspect of the present invention, there is provided a document feeder which comprises: a main body; a cover covering a portion of the top face of the main body and adapted to be pivotally opened; a separator mechanism having a first separator member and a second separator member opposed to the first separator member, the first and second separator members cooperating to separate and feed document originals one by one into a document transportation path, the second separator member being adapted to be brought apart from the first separator member when the cover is opened; and a positioning mechanism for positioning the second separator member with respect to the first separator member with a predetermined distance between the first and second separator members when the cover is closed, the distance between the first and second separator members being adjustable.

In accordance with the invention, the positioning mechanism for positioning the second separator member with respect to the first separator member with the cover being closed has a function to adjust the distance (overlap amount) between the first and second separator members, thereby obviating the troublesome operation for the replacement of the overlap defining member. Hence, there is no need for purchasing and storing spare overlap defining members, thereby reducing the costs.

In accordance with another embodiment of the present invention, the first separator member and the second separator member are provided in the main body and in the cover, respectively, and the positioning mechanism includes a positioning member attached to the second separator member in such a manner that the positioning member can be displaced with respect to the second separator member, and a receiving member provided in the main body for receiving the positioning member at a vertical level defined thereby with the cover being closed.

With this arrangement, the positioning member is received by the receiving member at the vertical level defined thereby. By preliminarily setting the vertical level of the positioning member at such a level that the second separator member can be positioned with respect to the first separator member with a predetermined overlap amount, the second separator member can assuredly be positioned with respect to the first separator member with the predetermined overlap amount when the cover is closed.

Since the positioning member can be displaced with respect to the second positioning member, the overlap amount between the first and second separator members can be changed if the vertical level of the positioning member is kept constant. Thus, the adjustment of the overlap amount can be achieved.

For the displacement of the positioning member with respect to the second separator member, such a construction may be employed that the positioning member has an elongate opening for receiving a fastening member inserted therein in a loosenable manner.

In this case, calibration marks are preferably provided on the positioning member or on the second separator member along a direction of the displacement of the positioning member with respect to a reference point provided on the second separator member.

The foregoing and other objects, features and effects of the present invention will become more apparent from the following description of the preferred embodiments with reference to the attached drawings.

DESCRIPTION OF THE PREFERRED EMBODIMENTS

Figure 1:
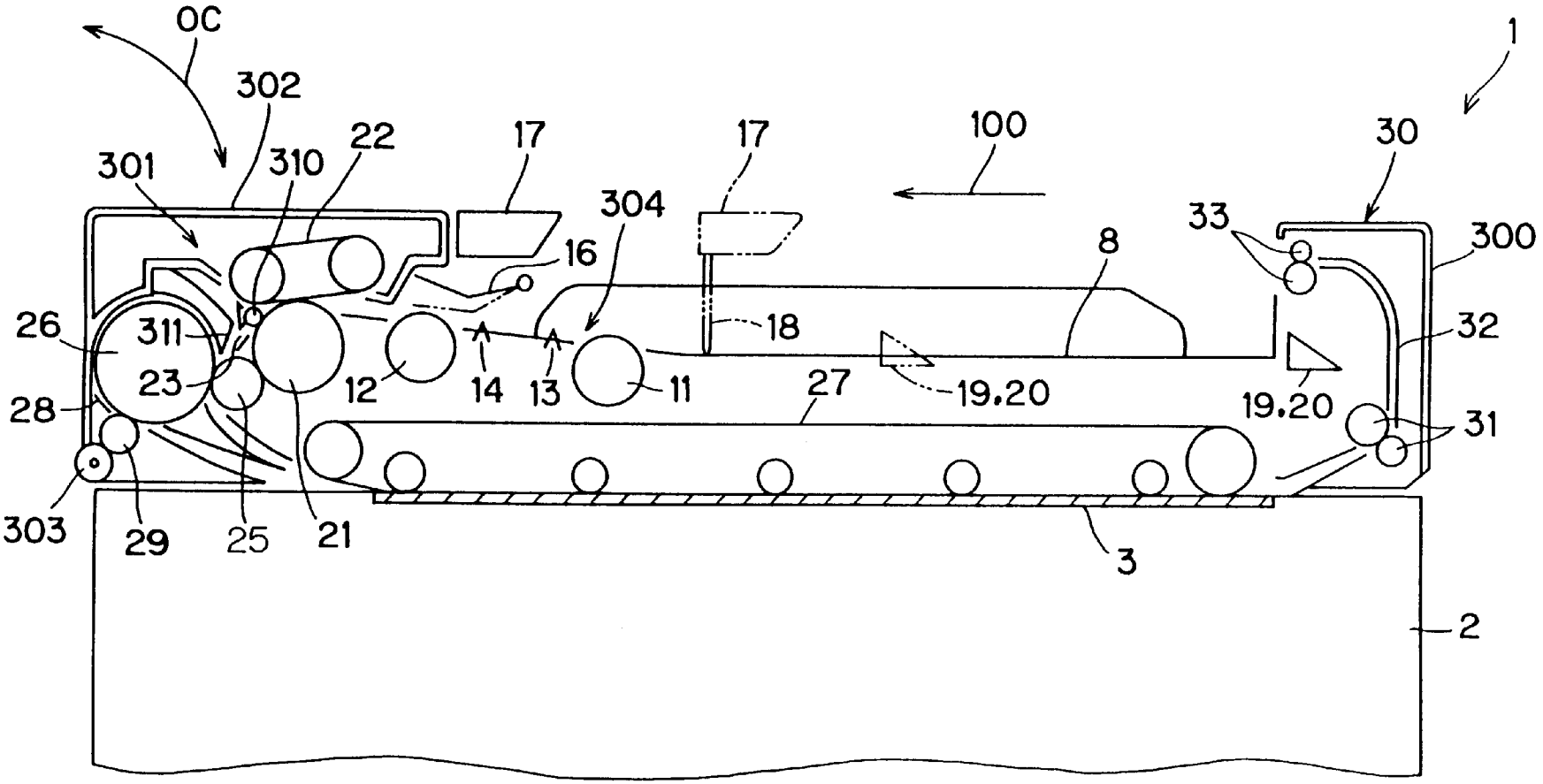
FIG. 1 is a sectional view schematically illustrating the internal construction of a recycle document feeder according to one embodiment of the present invention as viewed from the front side thereof.
Figure 2:
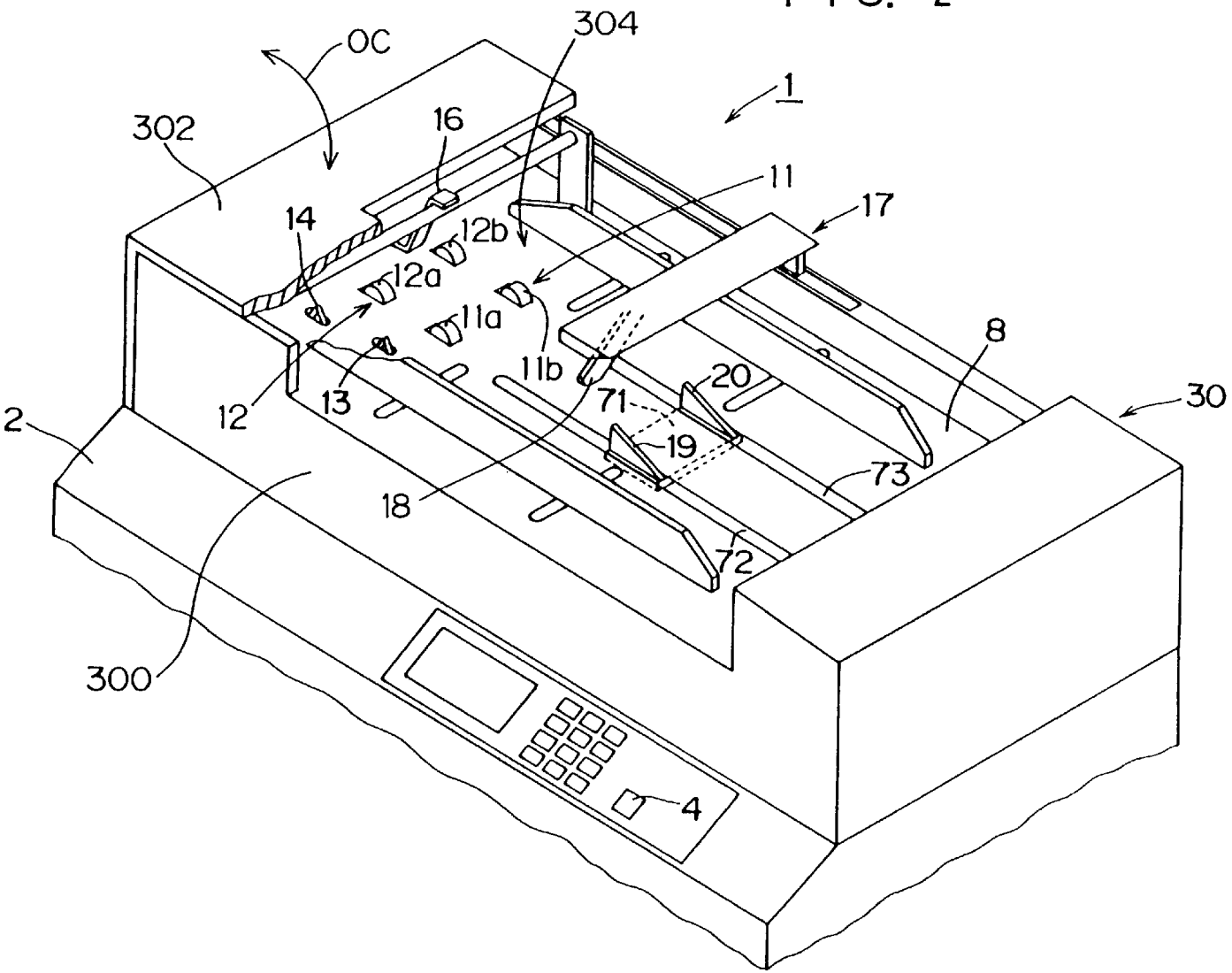
FIG. 2 is a partially cut-away perspective view of the recycle document feeder.

FIG. 1 is a sectional view schematically illustrating the internal construction of a recycle document feeder according to one embodiment of the present invention as viewed from the front side thereof. FIG. 2 is a partially cut-away perspective view of the recycle document feeder.

The recycle document feeder 1 is rested on the upper face of a copying machine body 2, and adapted to automatically feed a document original onto a contact glass 3 provided on the upper face of the copying machine body 2 and then back to the original position after image reading thereof. The document original thus fed back to the original position is allowed to be fed again onto the contact glass 3.

The recycle document feeder 1 includes a main body 300 and a feeder cover 302 covering a feeding mechanism 301. The feeder cover 302 is attached to the main body 300 in such a manner that the feeder cover 302 can cover the feeding mechanism 301 and be opened pivotally about a pivotal axis 303 along a lower edge of the main body 300 in opening and closing directions OC. When the feeder cover 302 is opened, the feeding mechanism 301 can be exposed to the outside.

A document placing plate 8 for holding thereon document originals to be fed onto the contact glass 3 is provided in the center of the upper face of the main body 300. The document placing plate 8 includes a feed out mechanism 304 for guiding the document originals to a predetermined feed position and assisting in the feeding of the document originals set in the feed position.

The feed out mechanism 304 includes a forward feed roller 11 and a main feed roller 12. As shown in FIG. 2, the forward feed roller 11 includes two unit rollers 11*a* and 11*b* spaced a predetermined distance from each other perpendicularly to a document transportation direction. The main roller 12 includes two unit rollers 12*a* and 12*b* spaced a predetermined distance from each other perpendicularly to the document transportation direction.

A preset switch 13 for detecting document originals placed on the document placing plate 8 is provided downstream of the forward feed roller 11 with respect to the document transportation direction. When a user places a stack of document originals on the document placing plate 8, the preset switch 13 is turned on to start driving the forward feed roller 11 and the main feed roller 12. As a result, the stack of document originals placed on the document placing plate 8 is transported in the direction of an arrow 100 (leftward as seen in FIG. 1).

A set switch 14 is provided downstream of the preset switch 13 with respect to the document transportation direction. The driving of the forward feed roller 11 and the main feed roller 12 is stopped after a lapse of a predetermined time period from a time point at which the set switch 14 is turned on by the transported document stack. Thus, the stack of document originals is set in the feed position.

When a print key 4 provided on the front upper portion of the copying machine body 2 is pressed with the document originals thus set in place, a partitioning unit 17 previously located in its home position (as indicated by a solid line in FIG. 1) above the forward feed roller 11 and the main feed roller 12 is moved in a direction opposite to the document transportation direction by a distance, which depends on the size of the document originals set in place, so as to be located in a position as indicated by a two-dot-and-dash line in FIG. 1.

The partitioning unit 17 includes a partitioning bar 18, which can be shifted between an inactive state where it is retracted within the partitioning unit 17 and an active state where it stops the leading edges of document originals fed back onto the document placing plate 8. When the document originals are subjected to a document feeding operation, the partitioning bar 18 is lowered to assume the active state, whereby the leading edges of the document originals fed back onto the document placing plate 8 through a document discharge portion 30 are aligned and the document originals subjected to the document feeding operation are divided from the document originals yet to be subjected to the document feeding operation.

In response to the pressing of the print key 4, two action plates 19 and 20 previously located in their home positions within the document discharge portion 30 (as indicated by a solid line in FIG. 1) are moved in the document transportation direction by a distance, which depends on the size of the document originals set in place, so as to be located in a position as indicated by a two-dot-and-dash line in FIG. 1. The action plates 19 and 20 are coupled by a coupling plate 71 below the document placing plate 8, and adapted to be moved in unison along guide rails 72 and 73 spaced apart from each other perpendicularly to the document transportation direction on the document placing plate 8.

The action plates 19 and 20 are each comprised of a generally right-angled triangular planar plate having an edge inclined upward toward the document transportation direction as viewed horizontally and perpendicularly to the direction of their movement. Therefore, a document original first fed back onto the document placing plate 8 is guided by the inclined edges of the action plates 19 and 20 so that the leading edge of the document original is prevented from bumping against the trailing edges of the document originals set in the feed position and rested thereon.

Further, in response to the pressing of the print key 4, a pressing member 16 provided above the main feed roller 12 is shifted from an upper position as indicated by a solid line in FIG. 1 to a lower position as indicated by a two-dot-and-dash line thereby to press the leading edge of the document stack set in the feed position against the main feed roller 12. Thus, a sufficient transportation force is applied to the document originals to be fed into the document transportation path 23.

The feeding mechanism 301 is provided downstream of the main feed roller 12 with respect to the document transportation direction. The feeding mechanism 301 includes a separator roller 21 for separating and feeding the document originals one by one from the feed position into the document transportation path 23, and a separator belt 22 opposed to the separator roller 21. The document transportation path 23 is curved with a predetermined curvature radius, and adapted to reverse a document original and feed the reversed document original to a copying position on the contact glass 3.

The feeding mechanism 301 includes a transportation assist roller 310 for applying a transportation assist force to the document original fed into the document transportation path 23, and a document guiding member 311 for guiding the document original to an abutment position where a registration roller 25 abuts against a registration/reverse roller 26. The transportation assist roller 310 is provided in the vicinity of an entrance port of the document transportation path 23 and abuts against the separator roller 21. The document guiding member 311 defines a part of a wall of the document transportation path 23 and extends to the vicinity of the abutment position between the registration roller 25 and the registration/reverse roller 26.

When the print key 4 is pressed, the movement of the partitioning unit 17 and the action plates 19 and 20, the positional shift of the pressing member 16 and the driving of the forward feed roller 11 and the main feed roller 12 are started. As a result, the lowermost one of the document originals (in the document stack) is separated from the other document originals and fed into the document transportation path 23 by cooperation of the separator roller 21 and the separator belt 22.

The document original fed into the transportation path 23 is guided to an abutment position where the separator roller 21 abuts against the transportation assist roller 310. As a result, a transportation assist force is applied to the document original fed into the document transportation path 23. Thus, even if the document original is thick and stiff, the document original can be guided to the abutment position between the registration roller 25 and the registration/reverse roller 26 without bumping against the interior wall surface of the document transportation path 23. The document guiding member 311 guides the document original to the abutment position between the registration roller 25 and the registration/reverse roller 26.

The document original guided to the abutment position between the registration roller 25 and the registration/reverse roller 26 is further transported by the rollers 25 and 26 driven in a predetermined timing, and then placed in the copying position on the contact glass 3 of the copying machine body 2 by the transportation belt 27. Where only an image on one side of the document original is to be read, a document image reading operation is performed by the copying machine in this state. Conversely, where images on both sides of the document original are to be read, the document original is reversed before the image reading operation.

More specifically, the document original placed on the contact glass 3 is taken back into a reversing path 28 by the transportation belt 27. The document original thus taken back is transported through the reversing path 28 by the transportation belt 27, by the registration/reverse roller 26 and a reverse roller 29 and by the registration roller 25 and the registration/reverse roller 26, and placed on the contact glass 3 again by the transportation belt 27. Then, the document original is subjected to the image reading operation by the copying machine so that the image on the back side of the document original is first read. Thereafter, the document original is reversed again, and the image on the front side of the document original is read.

The document original subjected to the image reading operation is transported to the document discharge portion 30 by the transportation belt 27. The document original transported to the document discharge portion 30 is further transported through a discharging path 32 by a discharge roller pair 31, and then discharged onto the document placing plate 8 by a discharge roller pair 33. Thus, the document original subjected to the image reading operation is fed back onto the document placing plate 8.

Figure 3:
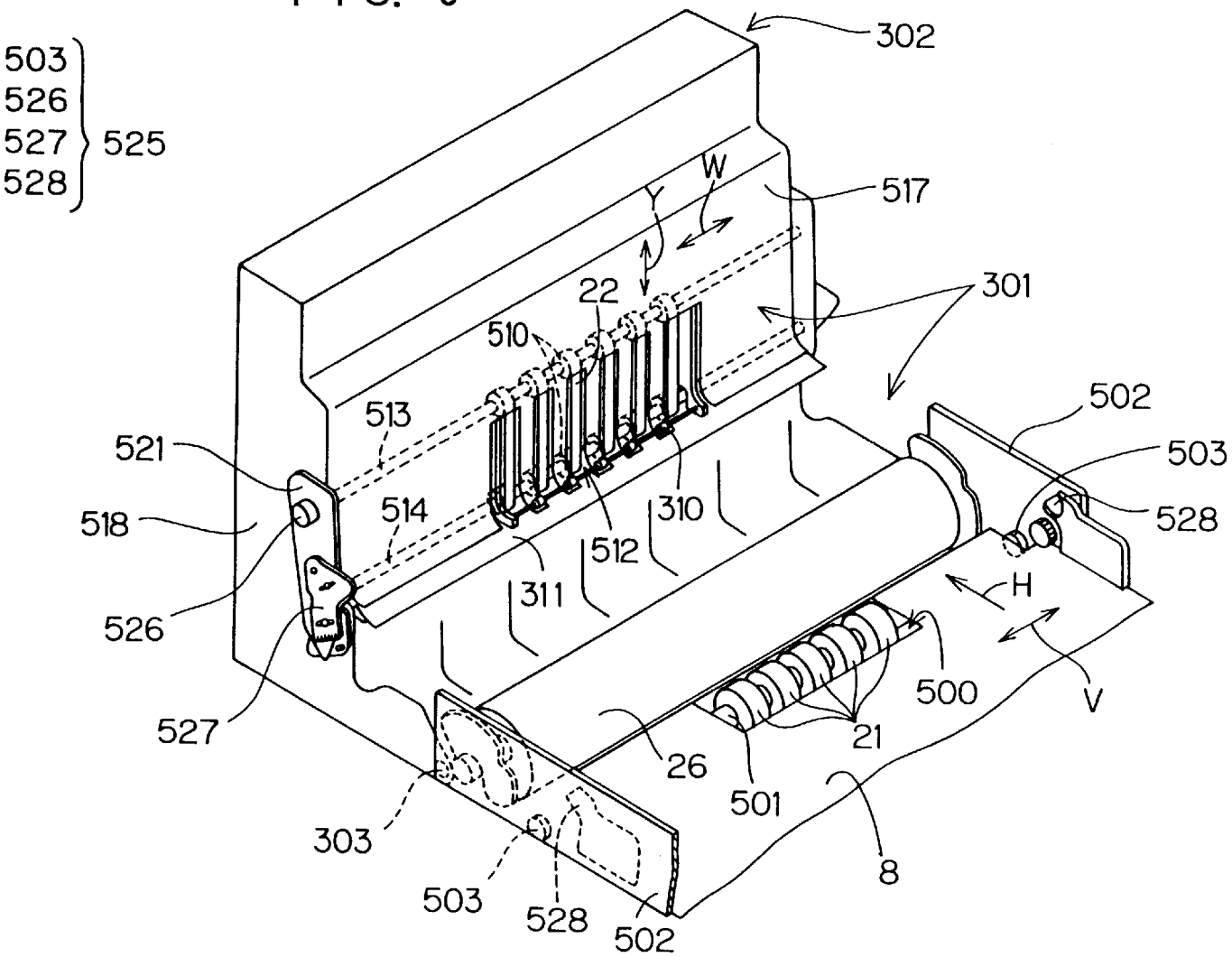
FIG. 3 is a perspective view illustrating a portion of the recycle document feeder with its feeder cover being opened.

FIG. 3 is a perspective view illustrating a portion of the recycle document feeder with the feeder cover 302 being opened. As described above, the feeder cover 302 is attached to the main body 300 in such a manner that the feeder cover 302 can be opened pivotally about the pivotal axis 303 to expose the feeding mechanism 301 to the outside. The components of the feeding mechanism 301 are dividedly provided in the main body 300 and in the feeder cover 302. More specifically, the separator roller 21 serving as the first separator member and the registration/reverse roller 26 are provided in the main body 300. The separator belt 22 serving as the second separator member, the transportation assist roller 310 and the document guiding member 311 are provided in the feeder cover 302.

Thus, the separator roller 21 and the separator belt 22 are provided in the main body 300 and in the feeder cover 302, respectively. Therefore, when the feeder cover 302 is opened, the separator belt 22 is brought apart from the separator roller 21, so that the jam recovery operation can readily be performed.

The construction of the respective components of the feeder mechanism 301 will hereinafter be described in greater detail.

The separator roller 21 includes a plurality of unit separator rollers (five unit separator rollers in FIG. 3) which are provided in an elongate opening 500 formed in a downstream middle portion of the document placing plate 8 and extending perpendicularly to the document transportation direction H (i.e., in a document width direction V), and arranged in a predetermined spaced relation along the document width direction V. The respective unit separator rollers 21 are fitted around a single roller shaft 501 extending in the document width direction V. The opposite ends of the roller shaft 501 are supported by bearings 503 provided on side plates 502 located on opposite sides of the main body 300 with respect to the document width direction V.

The separator belt 22 is provided in a generally middle portion of the feeder cover 302, i.e., in such a position that the separator belt 22 is opposed to the separator roller 21 when the feeder cover is closed. The separator belt 22 includes a plurality of unit separator belts (six unit separator belts in FIG. 3) provided in a predetermined spaced relation along the width of the feeder cover 302 (i.e., in a cover width direction W). The unit separator belts are endless belts which are each stretched around a pair of pulleys 510 spaced a predetermined distance from each other perpendicularly to the cover width direction W (i.e., in a cover length direction Y). Portions of the respective unit separator belts are exposed out of a plurality of elongate belt exposure openings 512 (six belt exposure openings in FIG. 3) formed in an interior wall 517 of the feeder cover 302 along the cover length direction Y.

Figure 4:
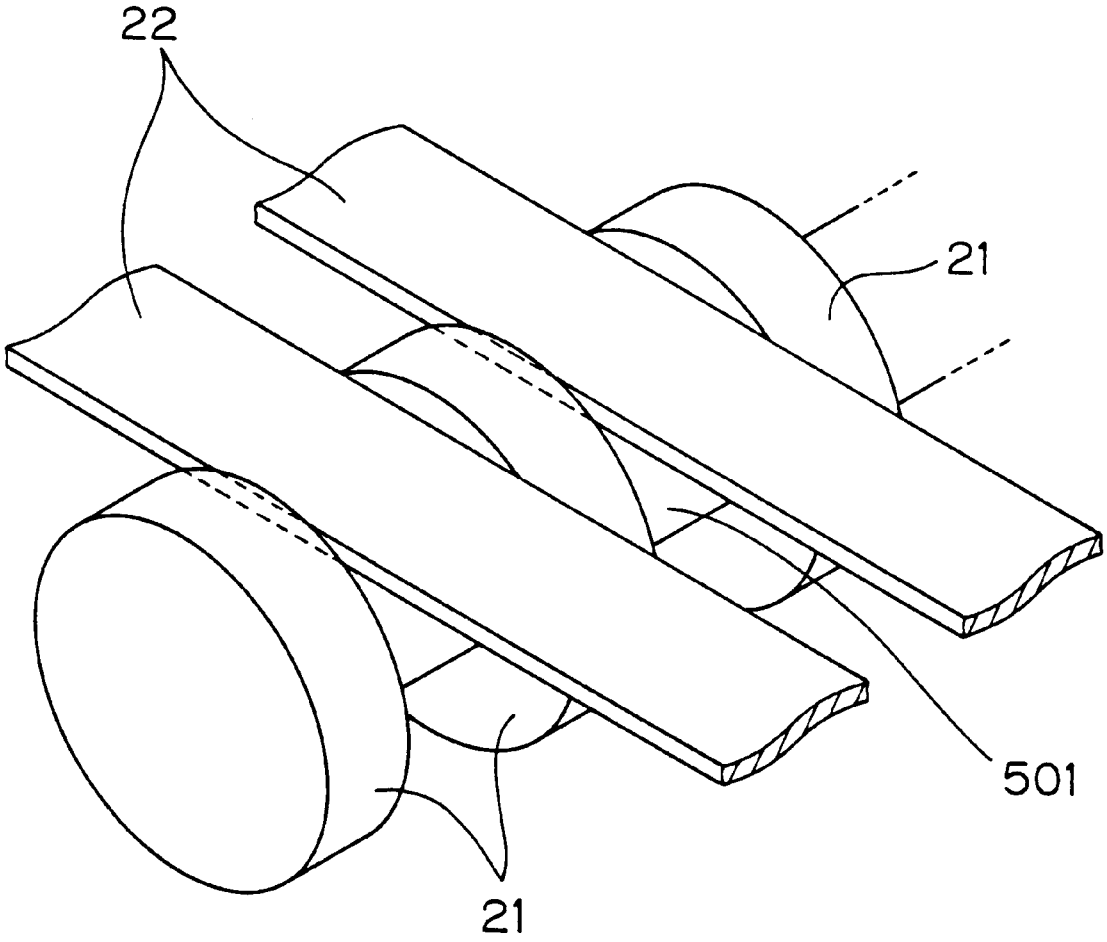
FIG. 4 is a perspective view illustrating a positional relation between a separator belt and a separator roller when the feeder cover is closed.

When the feeder cover 302 is closed, the unit separator rollers are each fitted between associated adjacent unit separator belts as shown in FIG. 4. Thus, the document original is held between the separator belt 22 and the separator roller 21 so as to be fed into the document transportation path 23 (see FIG. 1).

Referring back to FIG. 3, the separator belt 22 is movable with respect to the feeder cover 302. An arrangement related to the separator belt 22 will hereinafter be described with reference to FIG. 3 and FIG. 5 which is a perspective view illustrating a portion of the feeder cover 302.

As shown in FIG. 3, one of the pulleys 510 closer to the distal edge of the feeder cover 302 is fitted around a first belt shaft 513 extending in the cover width direction W, while the other pulley 510 closer to the pivotal axis 303 of the feeder cover 302 is fitted around a second belt shaft 514 extending in the cover width direction W.

Figure 5:
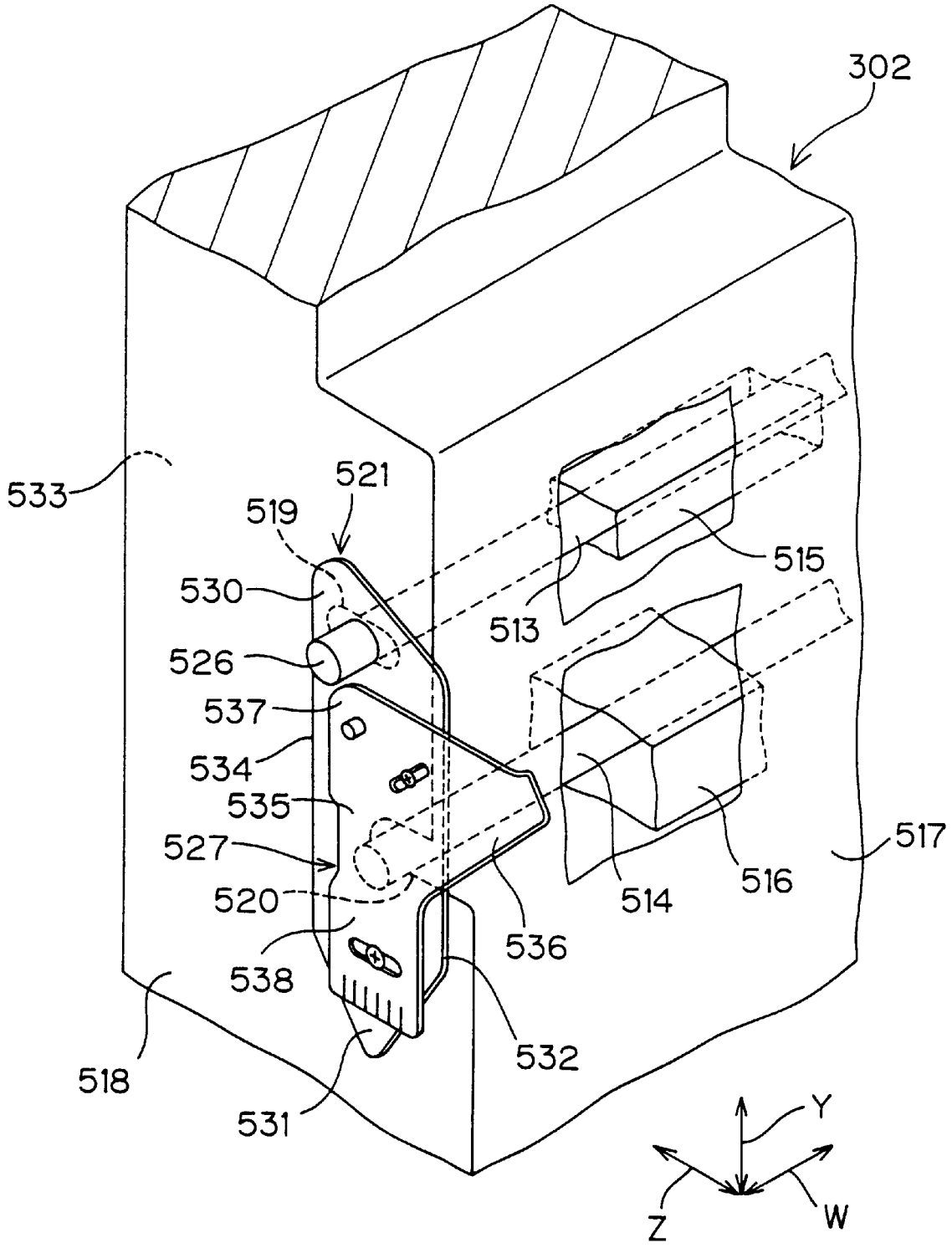
FIG. 5 is a perspective view illustrating a portion of the feeder cover.

As shown in FIG. 5, the first belt shaft 513 and the second belt shaft 514 extend through a first shaft space 515 and a second shaft space 516, respectively, extending along the cover width direction W within the feeder cover 302, and are accommodated therein with a play. More specifically, the first shaft space 515 and the second shaft space 516 each have a configuration such that the first belt shaft 513 and the second belt shaft 514 can be moved mainly along a direction Z perpendicular to the interior wall 517 of the feeder cover 302. The opposite ends of the first belt shaft 513 and the second belt shaft 514 are inserted in through-holes 519 and 520, respectively, formed in the side walls 518 of the feeder cover 302. Further, the opposite ends of the first belt shaft 513 are respectively coupled to the corresponding ends of the second belt shaft 514 by elongate planar coupling arms 521 each extending in the cover length direction Y with a distance between the shafts defined by the coupling arms 521.

Referring back to FIG. 3, the feeding mechanism 301 includes a positioning mechanism 525 for positioning the separator belt 22 movably provided in the feeder cover 302 with respect to the separator roller 21 when the feeder cover 302 is closed.

Figure 6:
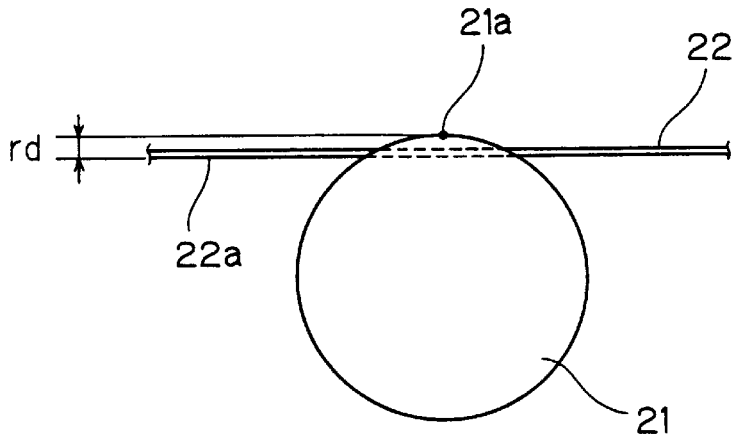
FIG. 6 is a diagram for explaining an overlap amount.

The positioning of the separator belt 22 with respect to the separator roller 21 means that the separator belt 22 is positioned with respect to the separator roller 21 in an overlapped relation with a predetermined overlap amount rd (see FIG. 6).

The overlap amount rd is an important parameter which determines the document separating performance. As shown in FIG. 6, the overlap amount rd corresponds to an overlap between an exposed surface 22*a* of the separator belt 22 and a top portion of the separator roller 21, and is represented by a distance between the exposed surface 22*a* and the top portion 21*a* of the separator roller 21. If the overlap amount rd is excessively small relative to the thickness of a document original, a plurality of document originals may be caught between the separator belt 22 and the separator roller 21, i.e., so-called plural document feeding may occur. Conversely, if the overlap amount rd is excessively great relative to the thickness of a document original, the document original may be deformed so that smooth transportation thereof is hindered.

Referring back to FIG. 3, the positioning mechanism 525 includes a positioning pin 526 as the first positioning member and an abutment plate 527 as the second positioning member respectively attached to the coupling arm 521 located in a fixed positional relation with respect to the separator belt 22, a pin engagement portion 528 as the first receiving portion provided on an interior face of the side plate 502 of the main body 300 and adapted to engage with the positioning pin 526 when the feeder cover 302 is closed, and the bearing 503 as the second receiving member for the roller shaft 501 of the separator roller 21 provided in the main body 300 and adapted to abut against the abutment plate 527 when the feeder cover 302 is closed.

The coupling arm 521 to which the positioning pin 526 and the abutment plate 527 are attached is an elongate planer plate extending along the cover length direction Y of the feeder cover 302 as shown in FIG. 5. More specifically, the coupling arm 521 has an end portion 530 closer to the distal edge of the feeder cover 302 (hereinafter referred to as "support portion 530"), an end portion 531 closer to the pivotal axis 303 (see FIG. 3) of the feeder cover 302 (hereinafter referred to as "distal end portion 531"), a first edge 532 located on the side of the interior wall 517 of the feeder cover 302, and a second edge located on the side of an exterior wall 533 of the feeder cover 302.

The positioning pin 526 is of a circular cylindrical shape projecting outward in the cover width direction W and is attached to the coupling arm 521 in a position such as to be opposed to the first belt shaft 513 across the coupling arm 521. The abutment plate 527 is attached to the coupling arm 521 in a position closer to the distal end portion 531 of the coupling arm 521 than the positioning pin 526, and has an elongate base portion 535 extending along the length of the coupling arm 521. The base portion 535 has a support portion 537 which is an end portion thereof closer to the support portion 530 of the coupling arm 521, and a distal end portion 538 which is an end portion thereof closer to the distal end portion 531 of the coupling arm 521. The abutment plate 527 further includes an abutment portion 536 formed integrally with the base portion 535 on the side of the support portion 537 of the base portion 535 and projecting from the first edge 532 of the coupling arm 521.

Figure 7:
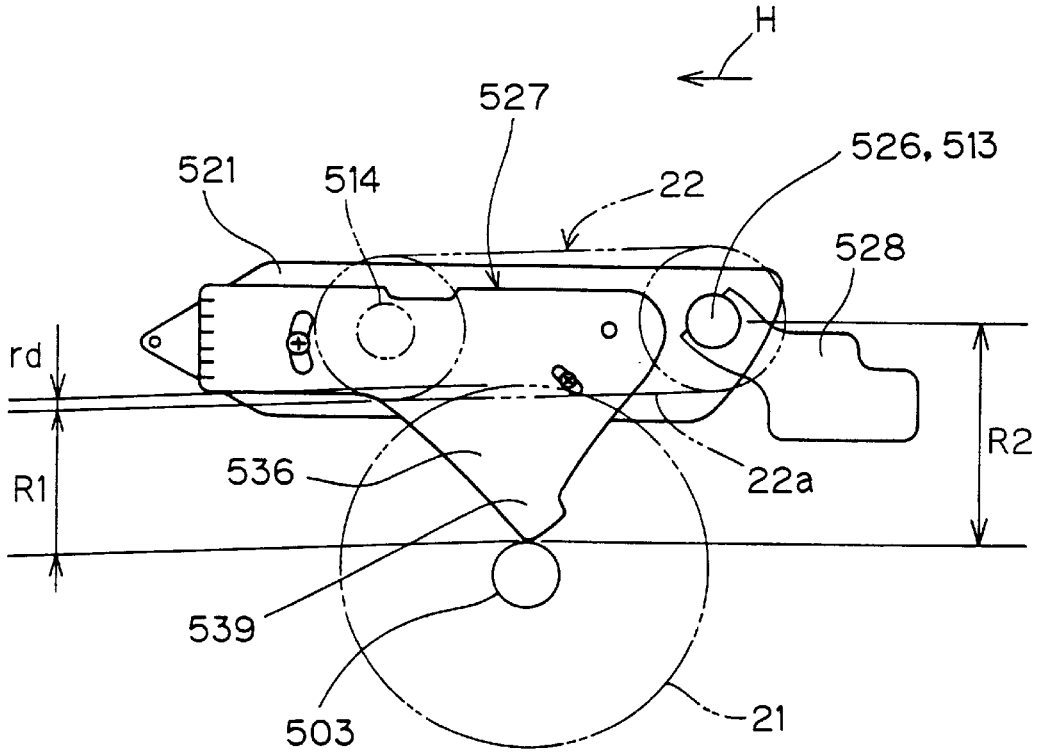
FIG. 7 is a diagram schematically illustrating a state where the separator belt is positioned with respect to the separator roller by a positioning mechanism with the feeder cover being closed.

With the feeder cover 302 being closed, the positioning pin 526 is engaged with the pin engagement portion 528 and a tip 539 of the abutment portion 536 of the abutment plate 527 abuts against the bearing 503 for the roller shaft 501 of the separator roller 21 as shown in FIG. 7. More specifically, the movable coupling arm 521 is properly positioned with respect to the document transportation direction H by engaging the positioning pin 526 with the pin engagement portion 528, and supported at two points along the length of the coupling arm 521 (along a direction generally parallel to the document transportation direction H) in this state. As a result, the coupling arm 521 is positioned at a predetermined vertical level with respect to the separator roller 21. That is, the separator belt 22 located in a fixed positional relation with respect to the coupling arm 521 is positioned at the predetermined vertical level with respect to the separator roller 21.

The vertical level of the separator belt 22 with respect to the separator roller 21 is defined by a distance R1 between the tip of the abutment portion 536 and the exposed surface 22*a* of the separator belt 22 which is opposed to the separator roller 21 with the feeder cover 302 being closed (hereinafter referred to as "first level defining distance R1") and by a distance R2 between the pin engagement portion 528 and the bearing 503 for the roller shaft 501 of the separator roller 21 (hereinafter referred to as "second level defining distance R2").

In this embodiment, the first level defining distance R1 and the second level defining distance R2 are determined so that the separator belt 22 overlaps the separator roller 21 with the predetermined overlap amount rd with the feeder cover 302 being closed. Thus, the separator belt 22 is positioned with respect to the separator roller 21 in an overlapped relation with the predetermined overlap amount rd when the feeder cover is closed.

Since the separator belt 22 is provided in the feeder cover 302 in this embodiment, the separator belt 22 can be brought far apart from the separator roller 21 when the feeder cover 302 is opened for the jam recovery operation. Thus, the jam recovery operation can readily be performed.

Further, the separator belt 22 can be positioned with respect to the separator roller 21 with a high accuracy regardless of the positioning accuracy with which the feeder cover 302 is positioned with respect to the main body 300, because the separator belt 22 is movable with respect to the feeder cover 302 and the positioning mechanism 525 is provided in association with the separator belt 22. Even if the feeder cover 302 is deformed due to the aging thereof and is positioned in an offset relation with respect to the main body 300, for example, the separator belt 22 can accurately be positioned with respect to the separator roller 21. Therefore, the deterioration of the document separating performance can be suppressed when compared with a case where the separator belt 22 is fixed to the main body 300.

Where document originals to be fed have the same thickness, the fixed overlap amount rd results in no problem as long as the overlap amount rd is suitable for the thickness of the document original. Where users use document originals having different thicknesses, however, the overlap amount rd is not always suitable for the different thicknesses of the document originals, thereby resulting in the plural document feeding.

To cope with this problem, this embodiment is adapted to adjust the overlap amount rd between the separator belt 22 and the separator roller 21. As described above, parameters defining the overlap amount rd are the first level defining distance R1 and the second level defining distance R2. In this embodiment, the abutment plate 527 can be moved with respect to the coupling arm 521 in order to adjust the first level defining distance R1 with the second level defining distance R2 being fixed.

In this embodiment, the abutment plate 527 and the bearing 503 correspond to the positioning member and the receiving member, respectively.

Figure 8:
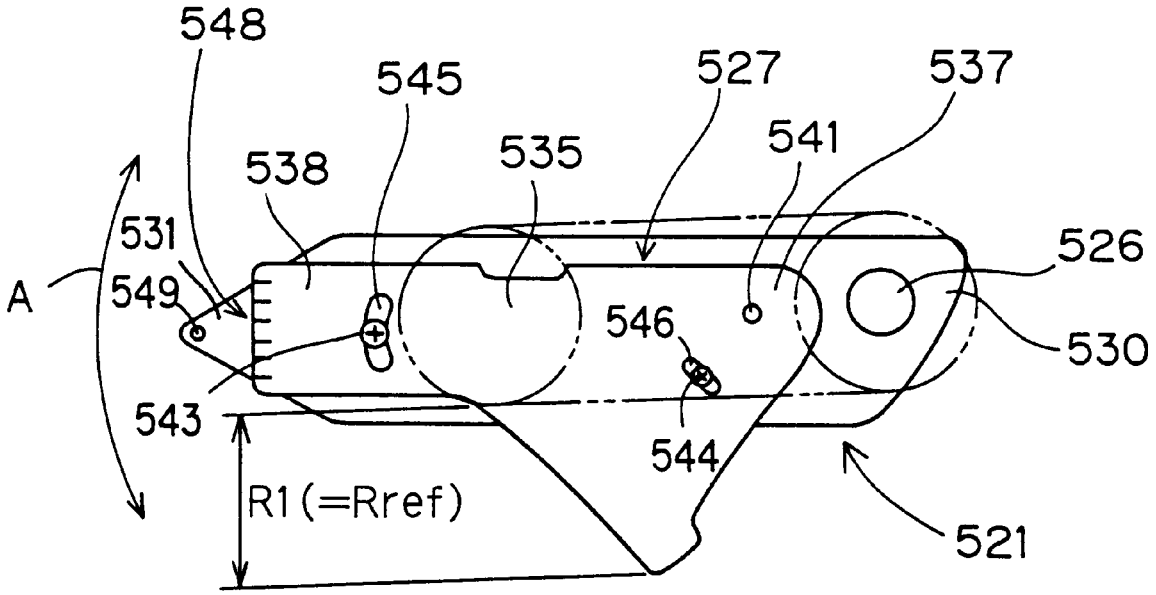
FIG. 8 is a plan view illustrating the construction of a coupling arm and an abutment plate.
Figure 9:
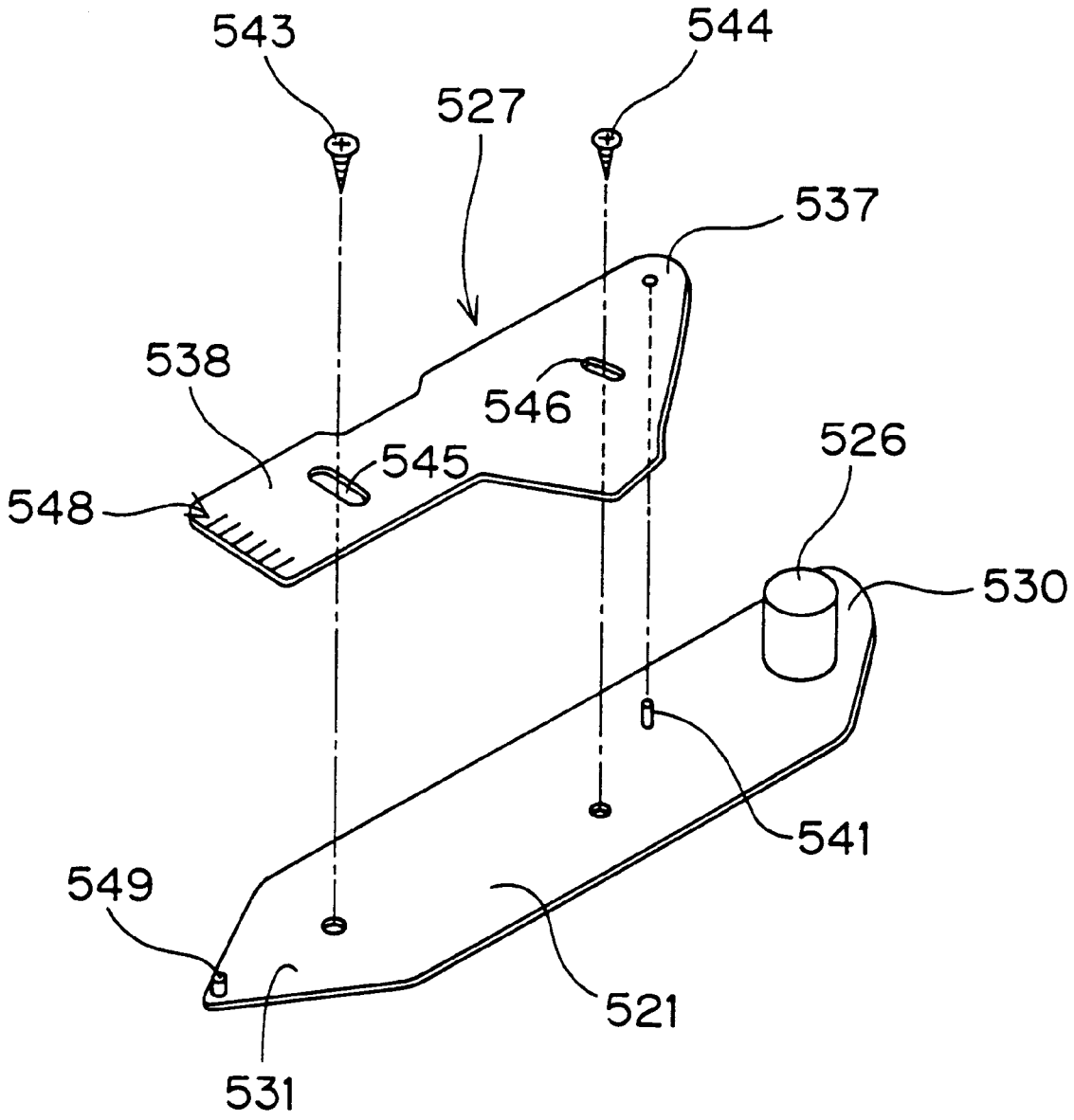
FIG. 9 is an exploded perspective view illustrating the construction of the coupling arm and the abutment plate.

FIG. 8 is a plan view illustrating the construction of the abutment plate 527 and the coupling arm 521. FIG. 9 is an exploded perspective view illustrating the construction of the abutment plate 527 and the coupling arm 521. The attachment of the abutment plate 527 to the coupling arm 521 will hereinafter be described with reference to FIGS. 8 and 9.

The abutment plate 527 is attached to the coupling arm 521 in such a manner that the support portion 537 of the base portion 535 thereof is supported pivotally about a attachment pin 541 projecting from the coupling arm 521 and that the distal end portion 538 of the base portion 535 and a portion of the base plate 535 adjacent to the attachment pin 541 are loosenably fastened to the bolts 543 and 544, respectively, as the fastening member.

Bolt holes 545 and 546 are formed in the abutment plate 527 for receiving the bolts 543 and 544, and each have an elongate configuration so that the abutment plate 527 can be pivoted about the attachment pin 541 in a direction A. Therefore, the distal end portion 538 of the abutment plate 527 can be pivoted about the attachment pin 541 by loosening the bolts 543 and 544.

As shown in FIG. 8, a reference position of the abutment plate 527 with respect to the coupling arm 521 is such a position that the base portion 535 is located generally parallel to the length of the coupling arm 521. The first level defining distance R1 obtained at this time provides a reference value Rref.

Calibration marks 548 are provided on the distal end portion 538 of the abutment plate 527 along the direction A of the pivoting of the abutment plate 527, so that a pivot amount of the abutment plate 527 can be read. At this time, a reference pin 549 provided at the distal end portion 531 of the coupling arm 521 serves as a reference point.

Figure 10A:
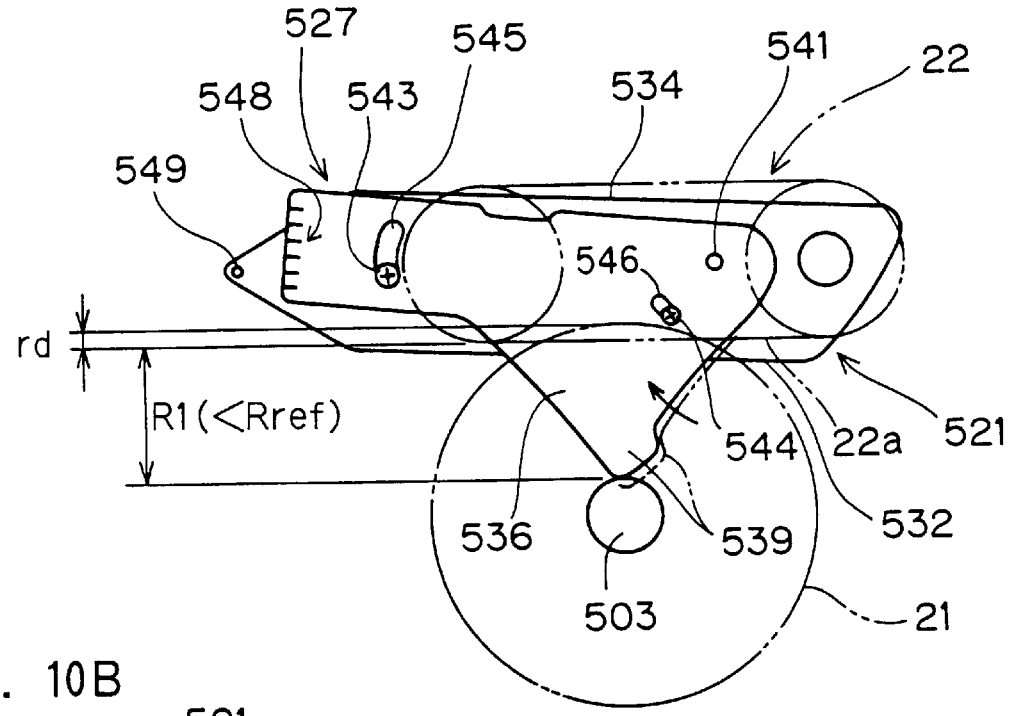
FIGS. 10A and 10B are diagrams for explaining a state where the abutment plate is displaced with respect to the coupling arm.

If the abutment plate 527 is displaced closer to the second edge 534 of the coupling arm 521 with the bolts 543 and 544 loosened as shown in FIG. 10A, for example, the tip 539 of the abutment portion 527 is displaced closer to the coupling arm 521 as indicated by a solid line in FIG. 10A. It is noted that a two-dot-and-dash line in FIG. 10A indicates the position of the tip 539 of the abutment portion 536 when the abutment plate 527 is located in the reference position with respect to the coupling arm 521. Since the separator belt 22 is attached to the coupling arm 521, the positional relation between the exposed surface 22*a* of the separator belt 22 and the coupling arm 521 is kept unchanged. As a result, the first level defining distance R1 becomes smaller than the reference value Rref. Therefore, the exposed surface 22*a* of the separator belt 22 is brought closer to the separator roller 21 with the feeder cover 302 being closed, so that the overlap amount rd is increased.

Figure 10B:
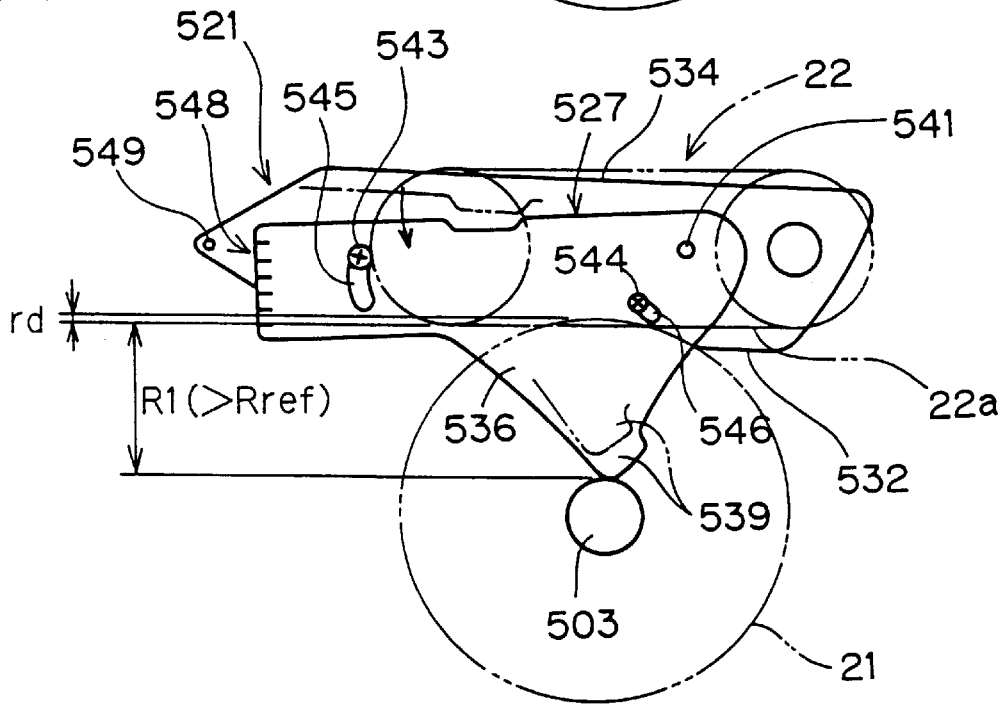

Conversely, if the abutment plate 527 is displaced closer to the first edge 532 of the coupling arm 521 with the bolts 543 and 544 loosened as shown in FIG. 10B, the tip 539 of the abutment portion 536 is displaced apart from the coupling arm 521. As a result, the first level defining distance R1 becomes greater than the reference value Rref. Therefore, the exposed surface 22*a* of the separator belt 22 is brought apart from the separator roller 21 with the feeder cover 302 being closed, so that the overlap amount rd is decreased.

As described above, the overlap amount rd can be adjusted by displacing the abutment plate 527 with respect to the coupling arm 521. Thus, the adjustment of the overlap amount rd can be facilitated. Therefore, the troublesome component replacing operation can be obviated which is required in the prior art. In addition, there is no need for providing a plurality of components for defining the overlap amount rd, thereby reducing the costs.

While one embodiment of the present invention has thus been described, the invention is not limited to this embodiment. In the embodiment described above, the first belt shaft 513 is movably attached to the feeder cover 302. This aims at accommodating the deformation of the feeder cover 302 which may occur due to the aging of the feeder cover 302. If the feeder cover 302 is formed of a less deformable material, the first belt shaft 513 may be fixed to the feeder cover 302.

Although the embodiment described above is directed to a case where the separator belt 22 is provided in the feeder cover 302, the separator belt 22 may be provided in the main body 300 in an opposed relation to the separator roller 21 and, for the purpose of the adjustment of the overlap amount, adapted to be brought apart from the separator roller 21 when the feeder cover 302 is opened.

The embodiment described above is directed to a case where the present invention is applied to a recycle document feeder to be mounted on a copying machine. Otherwise, the invention can be applied to a recycle document feeder for a facsimile machine or for an image reading apparatus connected to a computer or the like. Further, the invention can be applied not only to the recycle document feeder but also to an automatic document feeder which is adapted to discharge document originals to a special tray after the image reading operation.

The embodiment described above is directed to a case where the separator belt 22 is employed as the second separator member. Alternatively, another separator roller, for example, may be used as the second separator member.

While the present invention has been described in detail by way of the embodiment thereof, it should be understood that the foregoing disclosure is merely illustrative of the technical principles of the present invention but not limitative of the same. The spirit and scope of the present invention are to be limited only by the appended claims.

This application claims priority benefits of Japanese Patent Applications No. 9-7036 and No. 9-7037 filed on Jan. 17, 1997 under 35 USC 119, the disclosure thereof being incorporated herein by reference.

What is claimed is:

1. A document feeder, comprising:

a main body;

a cover covering a portion of the main body and adapted to be pivotally opened;

a separator mechanism having a first separator member provided in the main body, and a second separator member provided in the cover in such a manner that the second separator member is opposed to the first separator member when the cover is closed, the first and second separator members cooperating to separate and feed document originals one by one into a document transportation path; and a positioning mechanism for positioning the second separator member with respect to the first separator member with the cover being closed.

2. A document feeder as set forth in claim 1, wherein the positioning mechanism includes a positioning member attached to the second separator member, and a receiving member provided in the main body for receiving the positioning member with the cover being closed.

3. A document feeder as set forth in claim 1, wherein the second separator member is attached to the cover with at least a portion thereof being movable with respect to the cover.

4. A document feeder as set forth in claim 3, wherein the second separator member includes an endless belt stretched around a pair of pulleys, and a pair of coupling arms each defining a distance between corresponding ends of shafts of the pulleys and coupling the pulley shafts, at least one of the pulley shafts being movable with respect to the cover.

5. A document feeder as set forth in claim 4, wherein the positioning member includes a first positioning member provided on a shaft of one of the pair of pulleys and a second positioning member provided on the coupling arm, and wherein the receiving member includes a first receiving portion for receiving the first positioning member at a vertical level defined thereby with the cover being closed and a second receiving portion for receiving the second positioning member at a vertical level defined thereby with the cover being closed.

6. A document feeder as set forth in claim 5, wherein the pair of pulley shafts are provided in the cover with a play allowed in a document transportation direction, and wherein either one of the first and second receiving portions is adapted to position a corresponding positioning member with respect to the document transportation direction.

7. A document feeder as set forth in claim 1, wherein the positioning mechanism is adapted to position the second separator member with respect to the first separator member with a predetermined distance between the first and second separator members when the cover is closed, the positioning mechanism being adapted to adjust the distance between the first and second separator members.

8. A document feeder, comprising:

a main body;

a cover covering a portion of the main body and adapted to be pivotally opened;

a separator mechanism having a first separator member and a second separator member opposed to the first separator member, the first and second separator members cooperating to separate and feed document originals one by one into a document transportation path, the second separator member being brought apart from the first separator member when the cover is opened; and a positioning mechanism for positioning the second separator member with respect to the first separator member with a predetermined distance between the first and second separator members when the cover is closed, the positioning mechanism being adapted to adjust the distance between the first and second separator members.

9. A document feeder as set forth in claim 8, wherein the first separator member and the second separator member are provided in the main body and in the cover, resectively, and wherein the positioning mechanism includes a positioning member attached to the second separator member in such a manner that the positioning member can be displaced with respect to the second separator member, and a receiving member provided in the main body for receiving the positioning member at a vertical level defined thereby with the cover being closed.

10. A document feeder as set forth in claim 8, wherein the positioning member is formed with an elongate opening, and wherein a fastening member for fastening the positioning member to the second separator member is inserted in the elongate opening in a loosenable manner.

11. A document feeder as set forth in claim 10, wherein the second separator member includes an endless belt stretched around a pair of pulleys, and a pair of coupling arms each defining a distance between corresponding ends of shafts of the pulleys and coupling the pulley shafts, and wherein the fastening member is fastened to the coupling arm through the elongate opening of the positioning member in a loosenable manner.

* * * * *